US007707687B2

(12) United States Patent
Giovannetti

(10) Patent No.: US 7,707,687 B2
(45) Date of Patent: May 4, 2010

(54) OPENING/CLOSING DEVICE FOR A DOUBLE FLAP DOOR OF AN ITEM OF FURNITURE

(75) Inventor: Antonio Giovannetti, Segrate (IT)

(73) Assignee: Effegi Brevettie S.r.l., Segrate (Milano) (IT)

( * ) Notice: Subject to any disclaimer, the term of this patent is extended or adjusted under 35 U.S.C. 154(b) by 0 days.

(21) Appl. No.: 12/003,896

(22) Filed: Jan. 3, 2008

(65) Prior Publication Data

US 2008/0196203 A1 Aug. 21, 2008

(30) Foreign Application Priority Data

Feb. 15, 2007 (IT) ..... MI2007A0282

(51) Int. Cl.
*E05F 1/08* (2006.01)

(52) U.S. Cl. ..... 16/289; 16/366; 312/328; 160/213

(58) Field of Classification Search ..... 16/289, 16/287, 302, 366, DIG. 7; 312/109, 325–329, 312/271, 275, 276; 49/371, 203–204, 125–126, 49/339, 346; 160/207, 213, 188–189
See application file for complete search history.

(56) References Cited

U.S. PATENT DOCUMENTS

| | | | | |
|---|---|---|---|---|
| 5,882,099 | A * | 3/1999 | Salice | 312/328 |
| 6,332,660 | B1 * | 12/2001 | Salice | 312/328 |
| 6,877,830 | B2 * | 4/2005 | Salice | 312/327 |
| 7,168,477 | B2 * | 1/2007 | Salice | 160/213 |
| 7,240,974 | B2 * | 7/2007 | Hirtsiefer | 312/109 |
| 7,448,703 | B2 * | 11/2008 | Kung | 312/327 |

FOREIGN PATENT DOCUMENTS

| | | |
|---|---|---|
| DE | 1529652 | 1/1970 |
| EP | 1662082 | 5/2006 |

* cited by examiner

*Primary Examiner*—William L. Miller
(74) *Attorney, Agent, or Firm*—Jacobson Holman PLLC

(57) ABSTRACT

An opening/closing device for a double flap door of an item of furniture, wherein the top part and the bottom part of the door are not hinged to each other. The device is connected to the furniture item to cause the top part of the door to rotate with respect to the furniture item and an articulated quadrilateral causes the bottom part of the door to rotate with respect to the top part concomitantly with the rotation of the top part of the door with respect to the furniture item. The articulated quadrilateral includes a first and a second arm each having one end hinged to the bottom part of the door and the other end hinged to the device.

9 Claims, 4 Drawing Sheets

OPENING/CLOSING DEVICE FOR A DOUBLE FLAP DOOR OF AN ITEM OF FURNITURE

FIELD OF THE INVENTION

The present invention refers to an opening/closing device for a double flap door (comprising a top part and a bottom part not hinged to each other) of a furniture item, adapted to cause the two parts of the door to rotate upwards, with a gradual movement, until at least the top part is caused to assume a substantially horizontal open position, and respectively to cause the two parts of the flap to rotate downwards until the two parts of the flap are caused to assume a substantially vertical closed position.

BACKGROUND OF THE INVENTION

Many types of opening/closing devices for a double flap door based on the articulated quadrilateral principle are known to the art; their structural elements and operation will not be described herein because they are per se known.

It will merely be recalled that in opening/closing devices of the prior art, the two parts of the flap door are hinged to each other and, in the open position, fold over one another; the hinge between the two parts of the flap door forms one of the articulation points of the articulated quadrilateral, whereof one of rods is fixed to the bottom part of the door.

The fact that the two parts of the flap door are constrained to each other implies that:

- in the open position, the two parts of the flap door assume a (more or less) obligatory position;
- since the top part of the flap door is hinged to the edge (normally horizontal) of the furniture item, the sides of the two parts of the flap door hinged to each other must be horizontal and in any case parallel to the edge of the furniture item.

All this imposes aesthetic and functional constraints and/or limitations on the designers and technicians who design furniture.

SUMMARY OF THE INVENTION

Object of the present invention is to produce an opening/closing device for a double flap door which allows the limits and drawbacks presented by the opening/closing devices of the prior art to be overcome and which has aesthetic and functional features which increase the quality thereof, as required by the current design and market trends.

This object is achieved by means of an opening/closing device for a double flap door.

BRIEF DESCRIPTION OF THE DRAWINGS

The invention will now be described with reference to a purely exemplifying (and therefore non limiting) embodiment thereof, illustrated in the appended figures, wherein.

DETAILED DESCRIPTION OF THE PREFERRED EMBODIMENTS

Figure 2:
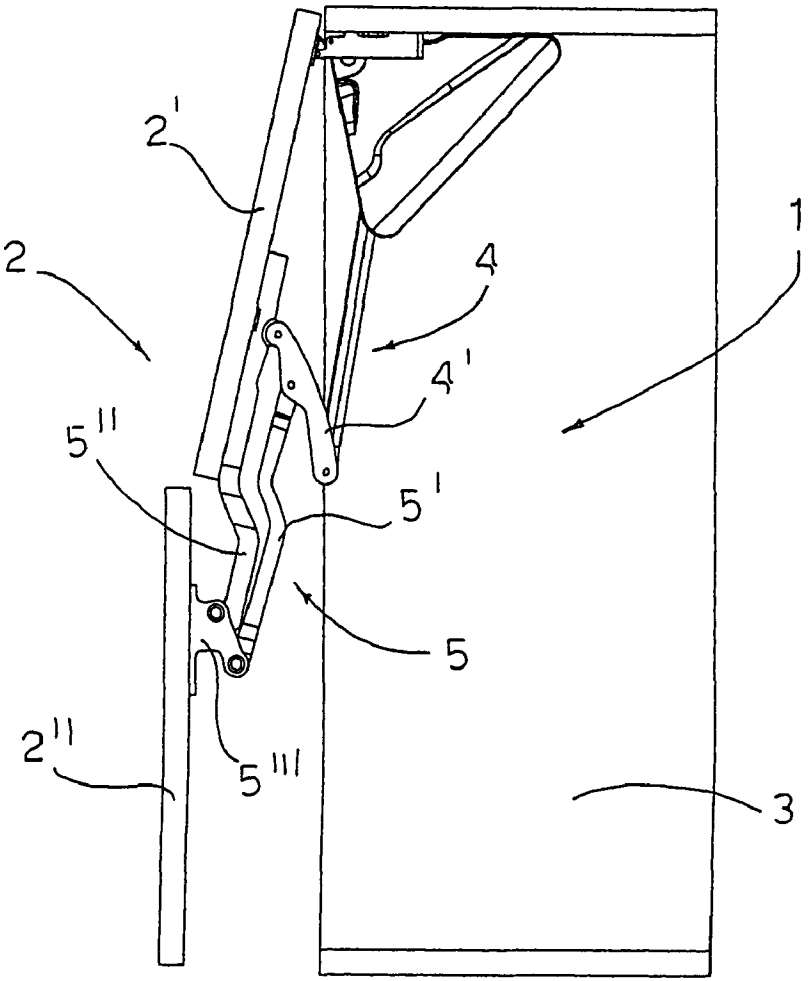
FIGS. 2 and 3 show diagrammatically two side views of the opening/closing device according to the invention, during opening of the double flap door.

In the appended figures corresponding elements will be identified by the same reference numerals.

An opening/closing device for a double flap door of a furniture item (comprising a top part and a bottom part not hinged to each other) comprises means connected to the furniture item and to the top part of the flap door and adapted to cause the top part of the flap to rotate with respect to the furniture item and an articulated quadrilateral, connected to said means and adapted to cause the bottom part of the flap to rotate with respect to the top part concomitantly with the rotation of the top part of flap door with respect to the furniture item.

The articulated quadrilateral preferably comprises a first and second arm each having one end hinged to a body integral with the bottom part of the flap door and the other end hinged to said means, the other end of one of the arms being integral with the top part of the flap door.

Figure 1:
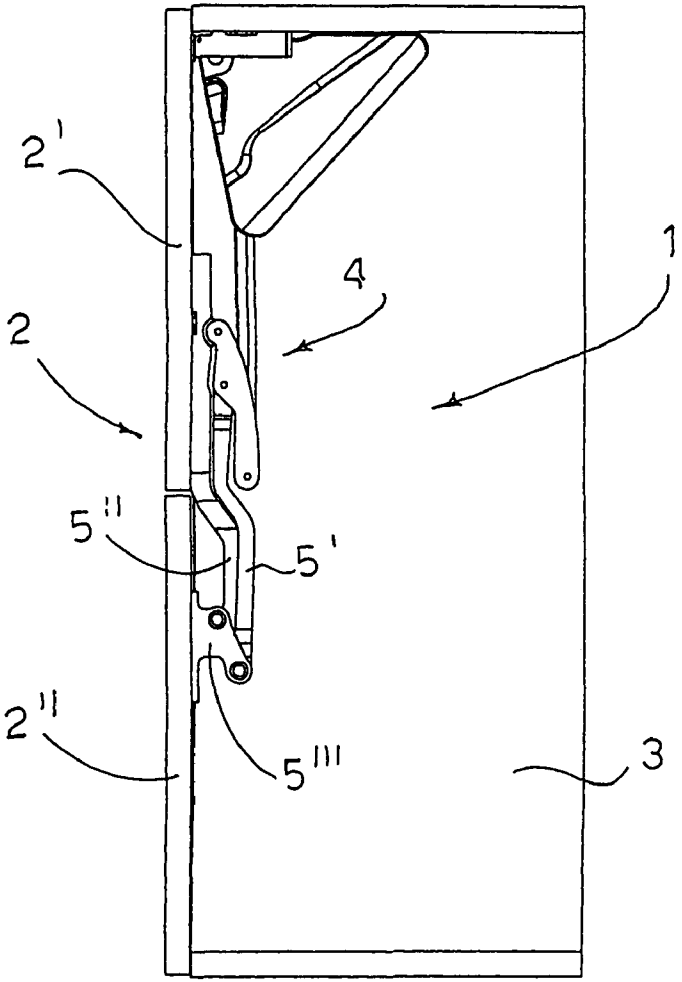
FIG. 1 shows diagrammatically a side view of an opening/closing device according to the invention, with the double flap door in the closed position.

FIG. 1 shows diagrammatically a side view of an opening/closing device 1 according to the invention, with the double flap door 2 in the closed position.

Visible in FIG. 1 are the two parts (2', 2") of the double flap door 2, the furniture item 3, the known means 4 (seen better in FIGS. 2-4 and consisting, in the embodiment described herein, of an articulated quadrilateral) connected to the furniture item 3 and the articulated quadrilateral 5 (seen better in FIGS. 2-4) which carries the bottom part 2" of the flap door 2.

The two parts (2', 2") of the flap door 2 are not hinged to each other.

Without departing from the scope of the invention, the articulated quadrilateral 4 can be replaced by another known, functionally equivalent device.

Figure 3:
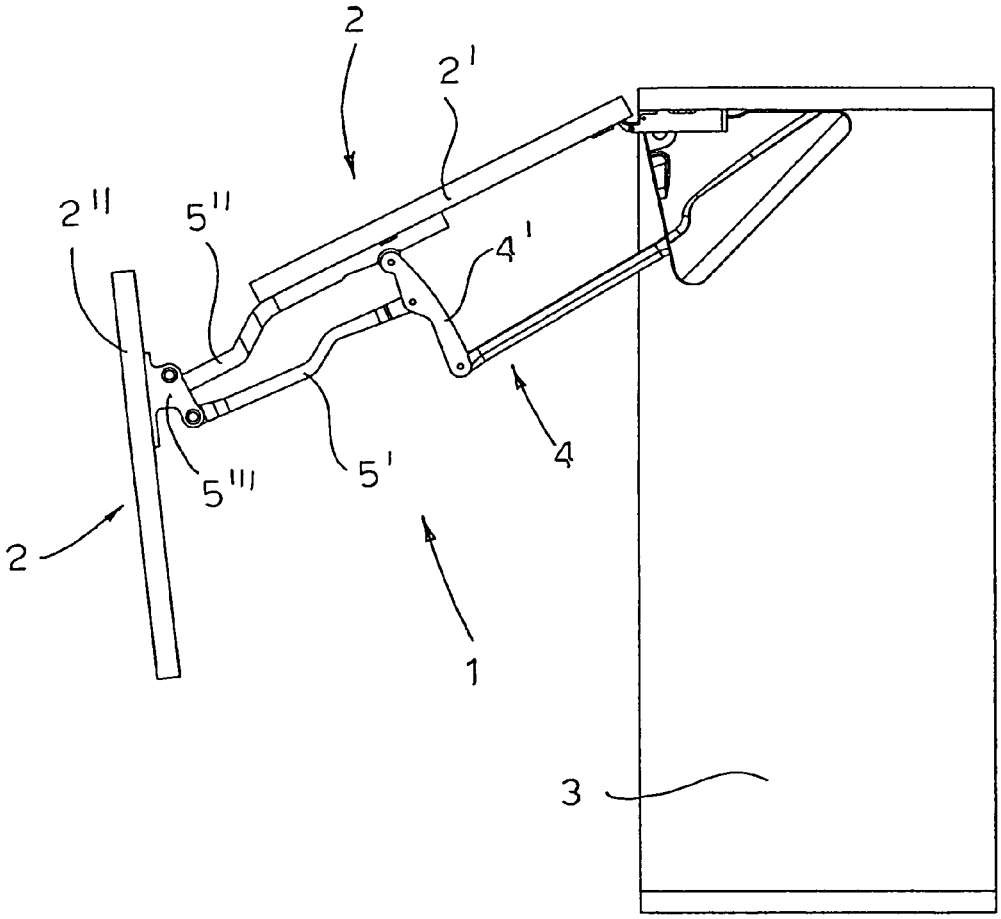

FIGS. 2 and 3 show diagrammatically two side views of the opening/closing device 1 of FIG. 1, during opening of the double flap door 2.

Visible in FIGS. 2 and 3 are the two parts (2', 2") of the flap door 2, the furniture item 3, the known means 4 connected to the furniture item 3 and the articulated quadrilateral 5 which carries the bottom part 2" of the flap door 2.

From FIGS. 2 and 3 it can be seen that the articulated quadrilateral 5 comprises a first and a second arm (5', 5") each having one end hinged to a body 5'" integral with the bottom part 2" of the flap door 2 and the other end hinged to the means 4 (in particular, in the embodiment of the means 4 described herein by way of non limiting example, the arm 5' is hinged to an intermediate point of the rod 4' belonging to the articulated quadrilateral 4).

In the attached figures the two parts (2', 2") of the flap door 2 are of practically the same height but, without departing from the scope of the invention, the two parts (2', 2") of the flap door 2 can be of different heights; the height of the bottom part 2" of the flap door 2 must not be less than the height of the body 5'", to which the first and second arm (5', 5") of the articulated quadrilateral 5 are hinged.

Figure 4:
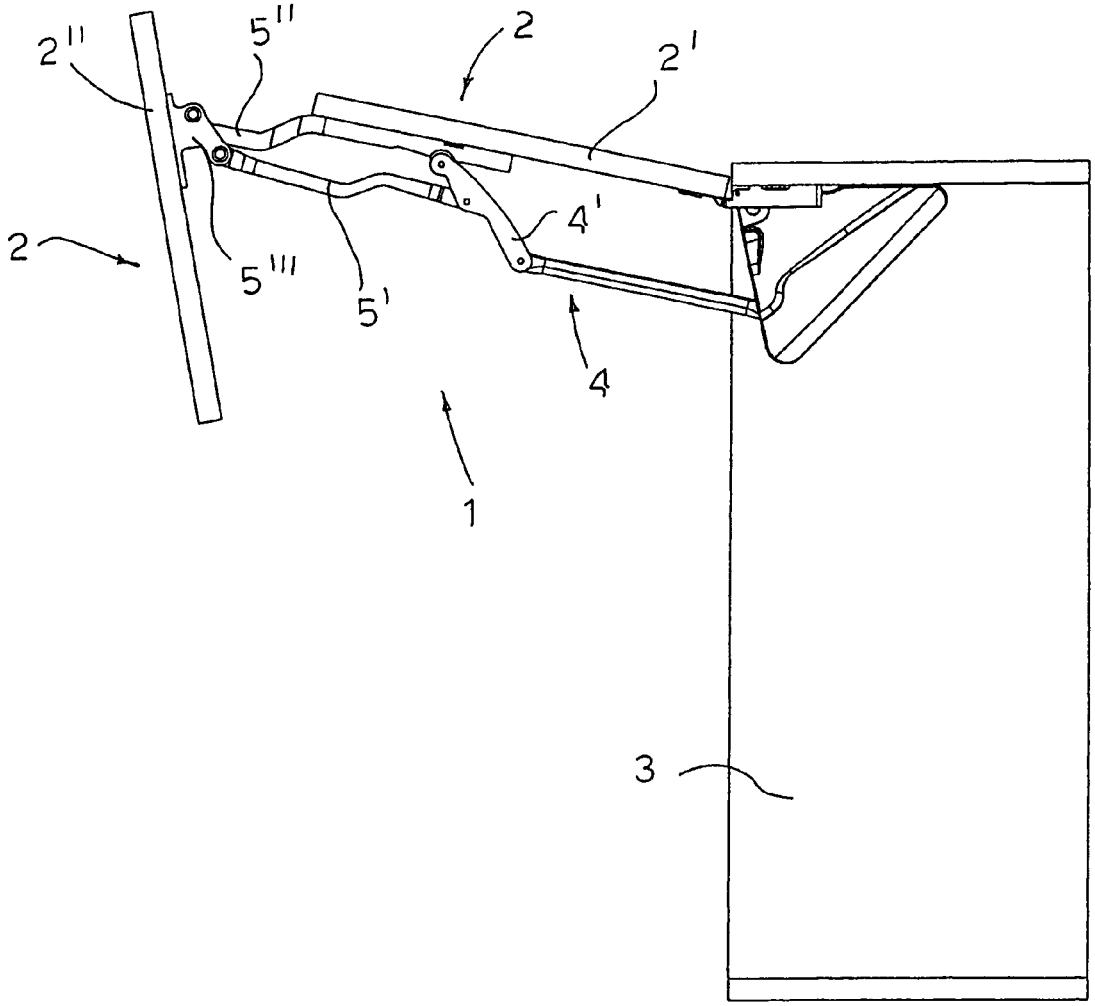
FIG. 4 shows diagrammatically a side view of the opening/closing device of FIG. 1, with the double flap door in the open position.

FIG. 4 shows diagrammatically a side view of the opening/closing device 1 of FIG. 1, with the double flap door 2 in the open position.

Visible in FIG. 4 are the two parts (2', 2") of the flap door 2, the furniture item 3, the known means 4 connected to the furniture item 3 and the articulated quadrilateral 5 which carries the bottom part 2" of the flap door 2.

From FIGS. 2-4 it can be seen that by suitably dimensioning (in an way obvious to a person skilled in the art) the means 4 and the arms 5' and 5", the bottom part 2" of the flap remains (almost) vertical, moving (almost) parallel to itself.

This is (or can be) advantageous if, for example, shelves, coat-hangers or the like are applied to the bottom part 2" of the flap door 2.

From FIG. 4 it can be seen that the positions assumed by the two parts (2', 2") of the flap door 2 in the open position are related to each other only by the lengths of the sides of the articulated quadrilateral 5 and can therefore be modified by a designer by modifying said lengths and/or their relationships.

Figure 5:
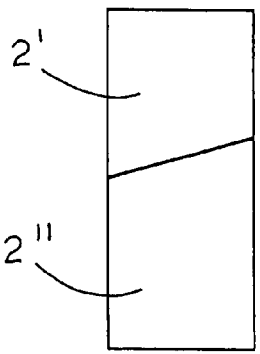
FIG. 5 shows diagrammatically a front view of a furniture item wherein the two parts of the double flap door have oblique adjacent sides.

FIG. 5 shows diagrammatically a front view of a furniture item 3 bearing a double flap door 2 wherein the two adjacent edges (2'*a*, 2"*a*; FIG. 6) of the two parts (2', 2") of the flap door 2 are parallel to each other and oblique or in any case not parallel to the edge of the furniture item 3 to which the top part 2' of the flap door 2 is hinged.

Without departing from the scope of the invention, the adjacent edges (2'*a*, 2"*a*) of the two parts (2', 2") of the flap door 2 may not be parallel to each other and may have different profiles (for example, one edge slanting upward and one slanting downward, or one edge may be straight and the other curved or undulating or both edges may be curved or undulating), provided there is no compenetration of the two parts (2', 2") of the flap door 2 in the closed position.

FIG. 6 shows diagrammatically, in a perspective view, some stages in opening of the double flap door 2 of the furniture item 3 of FIG. 5.

Visible in FIG. 6 are the two parts (2', 2") of the flap 2, their adjacent edges (2'*a* and 2"*a*) parallel to each other, the furniture item 3, the known means 4 connected to the furniture item 3 and the articulated quadrilateral 5 which carries the bottom part 2" of the flap door 2.

From FIG. 6 it can be seen that the device 1 of the present invention is adapted to move the two parts (2', 2") of the double flap door 2 even if their adjacent edges (2'*a*, 2"*a*) are oblique or in any case not parallel to the edge of the furniture item 3 to which the top part 2' of the flap door 2 is hinged.

Figure 7:
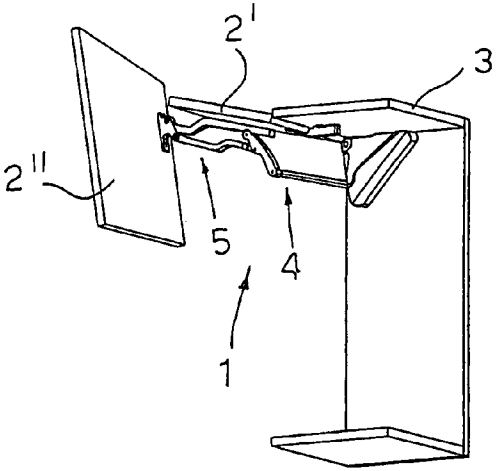
FIG. 7 shows diagrammatically, in a perspective view, the furniture item of FIG. 6*d* rotated to show the opening/closing device according to the invention.
Figure 6A:
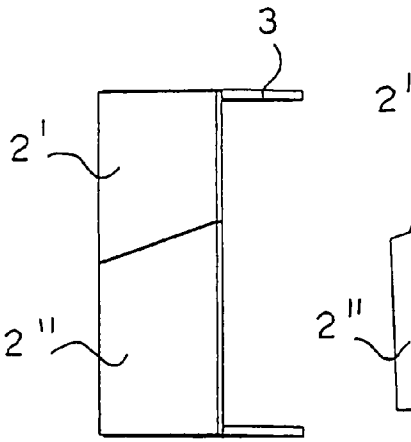
FIGS. 6*a*-6*d* show diagrammatically, in a perspective view, some stages of opening of the double flap door of the furniture item of FIG. 5.
Figure 6B:
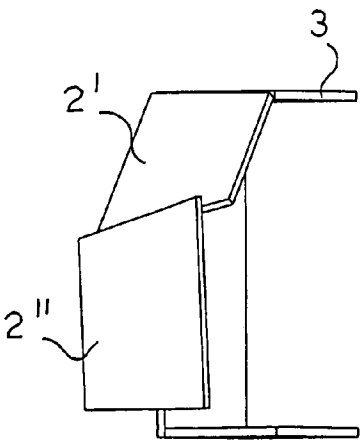
Figure 6C:
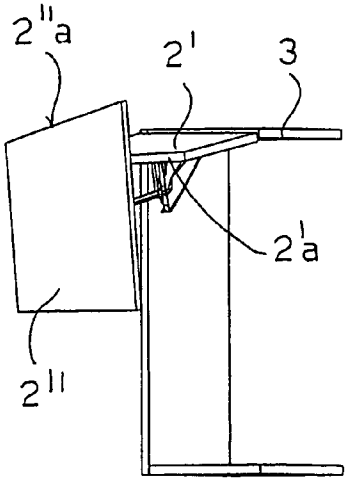
Figure 6D:
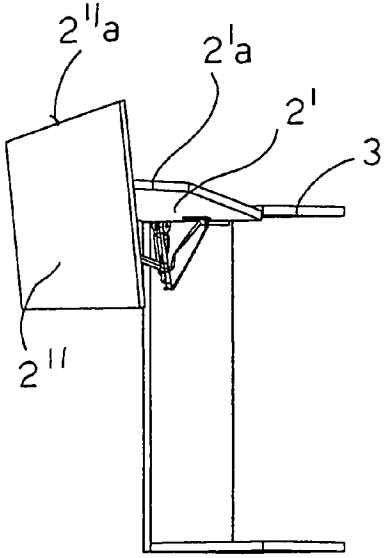

FIG. 7 shows diagrammatically in a perspective view, the furniture item 3 of FIG. 6*d* rotated to show the opening/closing device 1 according to the invention.

Visible in FIG. 7 are the two parts (2', 2") of the flap 2, their adjacent edges (2'*a* and 2"*a*), the furniture item 3, the known means 4 connected to the furniture item 3 and the articulated quadrilateral 5 which carries the bottom part 2" of the flap door 2.

Without departing from the scope of the invention, a person skilled in the art can make to the previously described opening/closing device for a double flap door all the changes and improvements suggested by normal experience and/or by the natural evolution of the art.

The invention claimed is:

1. An opening/closing device for a double flap door of an item of furniture, the flap door including a top part and a bottom part not directly hinged to each other at adjacent edges thereof, the opening/closing device comprising:

means connected to the item of furniture and adapted to cause the top part of the flap door to rotate with respect to the item of furniture; and a body which is integral with the bottom part of the flap door;

an articulated quadrilateral hingedly connected to the means and the body, the articulated quadrilateral includes a first and a second arm each having one end hinged to the body and the other end hinged to the means, the other end of one of the arms being integral with the top part of the flap door; and the articulated quadrilateral rotating the bottom part of the flap door with respect to the top part of the flap door concomitantly with rotation of the top part of the flap door with respect to the item of furniture.

2. The opening/closing device as in claim 1, wherein the top and the bottom parts of the door are of the same height.

3. The opening/closing device as in claim 1, wherein the top and the bottom parts of the door are of different heights.

4. The opening/closing device as in claim 1, wherein when the flap door passes from a closed position to an open position and vice versa, the bottom part of the flap door moves in a direction extending perpendicular to itself.

5. The opening/closing device as in claim 1, wherein a height of the bottom part of the flap door is no less than a height of the body to which one end of the first and second arms of the articulated quadrilateral is hinged.

6. The opening/closing device as in claim 1, wherein the adjacent edges of the top and bottom parts of the flap door are not parallel to an edge of the furniture item to which the top part of the flap door is hinged.

7. The opening/closing device as in claim 6, wherein the adjacent edges of the top and bottom parts of the flap door are oblique.

8. The opening/closing device as in claim 6, wherein the adjacent edges of the top and bottom parts of the flap door are parallel to each other.

9. The opening/closing device as in claim 6, wherein the adjacent edges of the top and bottom parts of the flap door have different profiles.

* * * * *